US011203901B2

(12) United States Patent
Cardon et al.

(10) Patent No.: US 11,203,901 B2
(45) Date of Patent: Dec. 21, 2021

(54) RADIAL DRILLING LINK TRANSMISSION AND FLEX SHAFT PROTECTIVE COVER

(71) Applicant: SCHLUMBERGER TECHNOLOGY CORPORATION, Sugar Land, TX (US)

(72) Inventors: Donald Cardon, Houston, TX (US); Bill DuBose, Jersey Village, TX (US); Mark Callister Oettli, Richmond, TX (US); Alexander Rudnik, Katy, TX (US); Harold Steve Bissonnette, Heber Springs, AR (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/630,035

(22) PCT Filed: Jul. 10, 2018

(86) PCT No.: PCT/US2018/041357
§ 371 (c)(1),
(2) Date: Jan. 10, 2020

(87) PCT Pub. No.: WO2019/014160
PCT Pub. Date: Jan. 17, 2019

(65) Prior Publication Data

US 2021/0087884 A1 Mar. 25, 2021

Related U.S. Application Data

(60) Provisional application No. 62/530,507, filed on Jul. 10, 2017, provisional application No. 62/530,574, filed on Jul. 10, 2017.

(51) Int. Cl.
*E21B 7/06* (2006.01)
*E21B 17/05* (2006.01)
*E21B 17/10* (2006.01)

(52) U.S. Cl.
CPC ..... *E21B 7/061* (2013.01); *E21B 17/05* (2013.01); *E21B 17/1085* (2013.01)

(58) Field of Classification Search
CPC ..... E21B 7/061; E21B 7/06; E21B 7/041
See application file for complete search history.

(56) References Cited

U.S. PATENT DOCUMENTS 2,731,414 A 1/1956 Binder, Jr.
2,808,109 A 10/1957 Kirk
(Continued)

FOREIGN PATENT DOCUMENTS

CN 102504292 A 6/2012
CN 105349166 A 2/2016
(Continued)

OTHER PUBLICATIONS

Alekseenko, O. P., Potapenko, D.I., Cherny, S.G., Esipov, D.V., Kuranakov, D.S., Lapin, V.N. "3-D Modeling of fracture initiation from perforated non-cemented wellbore", SPE J., vol. 18, No. 3, 589-600, 2013.

(Continued)

*Primary Examiner* — Kristyn A Hall
(74) *Attorney, Agent, or Firm* — Michael L. Flynn

(57) ABSTRACT

Systems and methods for performing a radial drilling operation using a shaft are disclosed. The shaft can be flexible and can be made of a series of links, each of which can have a hexagonal or other suitable shape to impart a torque along the linkage. A cable system can be run through the middle of the links and can be resiliently tensioned to permit a different degree of flexure according to the amount of (Continued)

tension in the cable and resilient member. Accordingly, the shaft can be rigid, selectively permitted to flex, or can be brought back to a straight or at least a less-bent position.

19 Claims, 13 Drawing Sheets

(56) References Cited

U.S. PATENT DOCUMENTS

| | | | |
|---|---|---|---|
| 3,282,337 | A | 11/1966 | Pye |
| 3,336,221 | A | 8/1967 | Ralston |
| 3,553,099 | A | 1/1971 | Savage |
| 3,704,750 | A | 12/1972 | Miles |
| 3,878,884 | A | 4/1975 | Raleigh |
| 3,892,274 | A | 7/1975 | Dill |
| 4,007,797 | A | 2/1977 | Jeter |
| 4,032,460 | A | 6/1977 | Zilch et al. |
| 4,036,732 | A | 7/1977 | Irani et al. |
| 4,046,668 | A | 9/1977 | Farcasiu et al. |
| 4,046,669 | A | 9/1977 | Blaine et al. |
| 4,108,760 | A | 8/1978 | Williams et al. |
| 4,139,450 | A | 2/1979 | Hanson et al. |
| 4,347,118 | A | 8/1982 | Funk et al. |
| 4,479,541 | A | 10/1984 | Wang |
| 4,519,463 | A | 5/1985 | Schuh |
| 4,613,631 | A | 9/1986 | Espenscheid et al. |
| 4,640,362 | A | 2/1987 | Schellstede |
| 4,666,683 | A | 5/1987 | Brown et al. |
| 4,848,486 | A * | 7/1989 | Bodine ..... E21B 7/06 175/55 |
| 4,977,961 | A | 12/1990 | Avasthi |
| RE33,660 | E | 8/1991 | Jelsma |
| 5,261,489 | A | 11/1993 | Jennings, Jr. et al. |
| 5,335,726 | A | 8/1994 | Rodrigues |
| 5,358,051 | A | 10/1994 | Rodrigues |
| 5,373,906 | A | 12/1994 | Braddick |
| 5,868,210 | A | 2/1999 | Johnson et al. |
| 5,893,416 | A | 4/1999 | Read |
| 6,581,690 | B2 | 6/2003 | Van Drentham-Susman et al. |
| 7,347,260 | B2 | 3/2008 | Ferguson et al. |
| 7,422,059 | B2 | 9/2008 | Jelsma |
| 7,431,083 | B2 | 10/2008 | Olsen |
| 7,441,595 | B2 | 10/2008 | Jelsma |
| 7,686,101 | B2 | 3/2010 | Belew et al. |
| 7,788,037 | B2 | 8/2010 | Soliman et al. |
| 7,971,658 | B2 | 7/2011 | Buckman, Sr. |
| 7,971,659 | B2 | 7/2011 | Gatlin et al. |
| 8,167,060 | B2 | 5/2012 | Brunet et al. |
| 8,201,643 | B2 | 6/2012 | Soby et al. |
| 8,220,547 | B2 | 7/2012 | Craig et al. |
| 8,372,786 | B2 | 2/2013 | Berkland et al. |
| 8,408,333 | B2 | 4/2013 | Pai et al. |
| 8,420,576 | B2 | 4/2013 | Eoff et al. |
| 8,424,620 | B2 | 4/2013 | Perry, Jr. et al. |
| 8,590,618 | B2 | 11/2013 | Jelsma |
| 8,672,034 | B2 | 3/2014 | Al-Ajmi et al. |
| 8,770,316 | B2 | 7/2014 | Jelsma |
| 9,121,272 | B2 | 9/2015 | Potapenko et al. |
| 9,567,809 | B2 | 2/2017 | Savage |
| 9,803,134 | B2 | 10/2017 | Wolf et al. |
| 10,005,955 | B2 | 6/2018 | Beuterbaugh et al. |
| 2002/0005286 | A1 | 1/2002 | Mazorow et al. |
| 2003/0062167 | A1 | 4/2003 | Surjaatmadja et al. |
| 2005/0056418 | A1 | 3/2005 | Nguyen |
| 2005/0230107 | A1 | 10/2005 | McDaniel et al. |
| 2006/0048946 | A1 | 3/2006 | Al-Muraikhi |
| 2006/0070740 | A1 | 4/2006 | Surjaatmadja et al. |
| 2006/0102343 | A1 | 5/2006 | Skinner et al. |
| 2007/0261852 | A1 | 11/2007 | Surjaatmadja et al. |
| 2007/0261887 | A1 | 11/2007 | Pai et al. |
| 2008/0078548 | A1 | 4/2008 | Pauls et al. |
| 2008/0135292 | A1 | 6/2008 | Sihler et al. |
| 2008/0139418 | A1 | 6/2008 | Cioletti et al. |
| 2009/0017678 | A1 | 1/2009 | Meier et al. |
| 2009/0065253 | A1 | 3/2009 | Suarez-Rivera et al. |
| 2009/0101414 | A1 | 4/2009 | Brunet et al. |
| 2009/0114385 | A1 | 5/2009 | Lumbye |
| 2009/0250211 | A1 | 10/2009 | Craig |
| 2009/0288884 | A1 | 11/2009 | Jelsma |
| 2010/0126722 | A1 | 5/2010 | Cornelissen et al. |
| 2010/0187012 | A1 | 7/2010 | Belew et al. |
| 2010/0243266 | A1 | 9/2010 | Soby et al. |
| 2010/0282470 | A1 | 11/2010 | Alberty et al. |
| 2011/0005762 | A1 | 1/2011 | Poole |
| 2011/0017468 | A1 | 1/2011 | Birch et al. |
| 2011/0061869 | A1 | 3/2011 | Abass et al. |
| 2011/0067871 | A1 | 3/2011 | Burdette et al. |
| 2011/0068787 | A1 | 3/2011 | Freedman et al. |
| 2011/0147088 | A1 | 6/2011 | Brunet et al. |
| 2012/0024530 | A1 | 2/2012 | Todd et al. |
| 2012/0067646 | A1 | 3/2012 | Savage |
| 2012/0160567 | A1 | 6/2012 | Belew et al. |
| 2012/0325555 | A1 | 12/2012 | Jette et al. |
| 2013/0000908 | A1 | 1/2013 | Walters et al. |
| 2013/0032349 | A1 | 2/2013 | Alekseenko et al. |
| 2013/0062125 | A1 | 3/2013 | Savage |
| 2013/0213716 | A1 | 8/2013 | Perry et al. |
| 2013/0220606 | A1 | 8/2013 | Yhuel et al. |
| 2013/0233537 | A1 | 9/2013 | McEwen-King et al. |
| 2013/0304444 | A1 | 11/2013 | Strobel et al. |
| 2013/0341029 | A1 | 12/2013 | Roberts et al. |
| 2014/0096950 | A1 | 4/2014 | Pyecroft et al. |
| 2014/0096966 | A1 | 4/2014 | Freitag |
| 2014/0102708 | A1 | 4/2014 | Purkis et al. |
| 2014/0144623 | A1 | 5/2014 | Pyecroft et al. |
| 2014/0340082 | A1 | 11/2014 | Yang et al. |
| 2015/0007988 | A1 | 1/2015 | Ayasse |
| 2015/0096748 | A1 | 4/2015 | West |
| 2015/0107825 | A1 | 4/2015 | Miller et al. |
| 2015/0218925 | A1 | 8/2015 | Lecampion et al. |
| 2015/0337613 | A1 | 11/2015 | Belew et al. |
| 2015/0356403 | A1 | 12/2015 | Storm, Jr. |
| 2016/0053597 | A1 | 2/2016 | Brown et al. |
| 2016/0115772 | A1 | 4/2016 | Graham et al. |
| 2016/0131787 | A1 | 5/2016 | Quirein et al. |
| 2016/0153239 | A1 | 6/2016 | Randall |
| 2016/0215581 | A1 | 7/2016 | Ingraham et al. |
| 2016/0281480 | A1 | 9/2016 | Pyecroft et al. |
| 2016/0312587 | A1 | 10/2016 | Montaron et al. |
| 2017/0030180 | A1 | 2/2017 | Maurer |
| 2017/0204713 | A1 | 7/2017 | Bell et al. |
| 2018/0023375 | A1 | 1/2018 | Potapenko et al. |
| 2018/0112468 | A1 | 4/2018 | Savage et al. |
| 2018/0163122 | A1 | 6/2018 | Panga et al. |
| 2018/0306017 | A1 | 10/2018 | Savage |
| 2018/0328118 | A1 | 11/2018 | Morse et al. |
| 2019/0017358 | A1 | 1/2019 | Morse et al. |
| 2020/0157901 | A1 | 5/2020 | Cardon et al. |

FOREIGN PATENT DOCUMENTS

| | | | |
|---|---|---|---|
| EP | 2198119 | A1 | 6/2010 |
| EP | 2631422 | A2 | 8/2013 |
| EP | 2672409 | A2 | 12/2013 |
| GB | 2406863 | A | 4/2005 |
| WO | 9113177 | A1 | 9/1991 |
| WO | 9420727 | A1 | 9/1994 |
| WO | 0046484 | A1 | 8/2000 |
| WO | 03050377 | A2 | 6/2003 |
| WO | 2004046494 | A2 | 6/2004 |
| WO | 2005090747 | A1 | 9/2005 |
| WO | 2009096805 | A1 | 8/2009 |
| WO | 2009157812 | A1 | 12/2009 |
| WO | 2013019390 | A1 | 2/2013 |
| WO | 2015089458 | A1 | 6/2015 |
| WO | 2016138005 | A1 | 9/2016 |
| WO | 2017074722 | A1 | 5/2017 |
| WO | 2017078989 | A1 | 5/2017 |
| WO | 2018049311 | A1 | 3/2018 |
| WO | 2018049367 | A1 | 3/2018 |
| WO | 2018049368 | A1 | 3/2018 |
| WO | 2018129136 | A1 | 7/2018 |
| WO | 2019014160 | A1 | 1/2019 |

(56) References Cited

FOREIGN PATENT DOCUMENTS

| | | | |
|---|---|---|---|
| WO | 2019014161 | A1 | 1/2019 |
| WO | 2019168885 | A1 | 9/2019 |
| WO | 2019241454 | A1 | 12/2019 |
| WO | 2019241455 | A1 | 12/2019 |
| WO | 2019241456 | A1 | 12/2019 |
| WO | 2019241457 | A1 | 12/2019 |
| WO | 2019241458 | A1 | 12/2019 |

OTHER PUBLICATIONS

Alekseenko O.P. , Potapenko D.I ., Kuranakov D.S. , Lapin V.N. , Cherny S.G. , and Esipov D.V. "3D Modeling of Fracture Initiation from Cemented Perforated Wellbore", presented at 19th European Conference on Fracture, Kazan, Russia, Aug. 26-31, 2012.

Potyondy, "Simulating stress corrosion with a bonded-particlle model for rock", International Journal of Rock Mechanics and Mining Sciences, vol. 44, Issue 5, Jul. 2007, pp. 677-691. https://www.sciencedirect.com/science/article/pii/S1365160906001560.

Atkinson et al., "Acoustic Emission During Stress Corrosion Cracking in Rocks", Earthquake Predition: An International Review, vol. 4, pp. 605-616, 1981. https://agupubs.onlinelibrary.wiley.com/doi/pdf/10.1029/ME004p0605.

Wikipedia.org, "Wood's metal", edited May 4, 2019, Accessed Jul. 3, 2019; https://en.wikipedia.org/wiki/Wood%27s_metal.

Pinto, I.S.S. et al., "Biodegradable chelating agents for industrial, domestic, and agricultural applications—a review", Environmental Science and Pollution Research, 2014, 21, pp. 11893-11906.

Office Action received in U.S. Appl. No. 16/629,992 dated Apr. 21, 2021, 53 pages.

* cited by examiner

RADIAL DRILLING LINK TRANSMISSION AND FLEX SHAFT PROTECTIVE COVER

BACKGROUND

Radial drilling is used to drill small-diameter horizontal wellbores. With this coiled tubing conveyed drilling technique, new wellbores are drilled perpendicular from the mother bore and into the reservoir formation. In a cased wellbore, a special cutting bottom hole assembly (BHA) is used to drill a hole in casing. This BHA is run through a workstring equipped with a deflector shoe that points sideways into casing when lowered downhole. The cutter BHA consists of a downhole positive displacement motor, a flexible driveshaft and a drill bit. The flexible driveshaft is designed to bend inside a short-radius curvature channel in the deflector shoe, transmit the force and torque from the PDM to the drill bit. Due to the nature of its design, the flexible shaft will bend by its own weight when placed at an angle that is different from straight down vertical position. This flexibility makes it difficult to convey the shaft and to stab it into the deflector shoe in deviated wellbores. Also, excessive compressive load applied to the shaft that is bent or buckled while being run in the hole or is hung up on an obstruction (or internal upset inside the wellbore) may severely damage or destroy the shaft.

Therefore, a solution is needed to ensure the shaft is prevented from bending and is protected from accidental compressive force at all times during run in hole (RIH), until it reaches the deflector shoe and the drill bit is inserted into the channel.

SUMMARY

Embodiments of the present disclosure are directed to systems for deploying a shaft in a safe, protected manner. The systems include a shaft configured to be operatively coupled to a motor to rotate the shaft, and a motor nose coupled to the shaft, the motor nose having a first coupling and a second coupling, with the first coupling being radially inward of the second coupling. The system also includes a tool shaft coupled to the first coupling and rotatable with the shaft and the motor nose. The system also includes a protective sleeve coupled to the second coupling on the motor nose, wherein the protective sleeve is rigid and has an interior diameter slightly larger than the outer diameter of the tool shaft. The tool shaft rests within the protective sleeve such that the protective sleeve prevents the tool shaft from flexing. The protective sleeve is configured to selectively retract into the motor nose to reveal the tool shaft.

In further embodiments the system includes a flex shaft collar having a torque-transmitting radial surface, and a cable coupled to the flex shaft collar, the cable having a proximal end coupled to the first coupling and a distal end. The system also includes a ball shank at the distal end of the cable, and a plurality of links nested into one another, each link having an interior bore configured to receive the cable. The links have a torque-transmitting radial surface, and the torque-transmitting radial surface of the flex shaft collar and of the links are configured to couple together such that imparting a torque to the links imparts the torque to the next successive link. The system can also include a bit adapter coupled to the distal end of the cable and configured to contact one of the links such that tension in the cable causes the bit adapter and the flex shaft collar to move toward one another.

Still further embodiments of the present disclosure are directed to a method of deploying a shaft into a wellbore. The method includes coupling a shaft to a motor shaft such that the motor shaft can rotate the shaft to perform a drilling operation, coupling a protective sleeve to the motor shaft with the protective sleeve covering substantially all the shaft, and running the shaft and protective sleeve into a wellbore. The method also includes retracting the protective sleeve from the shaft such that the shaft is permitted to flex, and rotating the motor shaft and the shaft to perform the drilling operation.

Yet further embodiments of the present disclosure are directed to a tool shaft including a flex shaft collar having a torque-transmitting radial surface, a cable coupled to the flex shaft collar, the cable having a proximal end and a distal end, wherein the proximal end is coupled to the flex shaft collar, and a plurality of links nested into one another, each link having an interior bore configured to receive the cable. The cable passes through the interior bore of the links. The links have a torque-transmitting radial surface. The torque-transmitting radial surface of the flex shaft collar and of the links are operably coupled together such that imparting a torque to the flex shaft collar imparts the torque through the links. The tool shaft further includes a bit adapter coupled to the distal end of the cable and configured to abut one of the links such that tension in the cable causes the bit adapter and the flex shaft collar to move toward one another.

Further embodiments of the tool shaft include a shaft coupled to the flex shaft collar, and a protective sleeve configured to move along the shaft between a retracted position and an extended position. The sleeve is at least slightly larger than the links in a radial direction such that the cable and links fit within the sleeve in the retracted position. The sleeve is sufficiently rigid to substantially prevent the cable from flexing when in the extended position.

Figure 4:
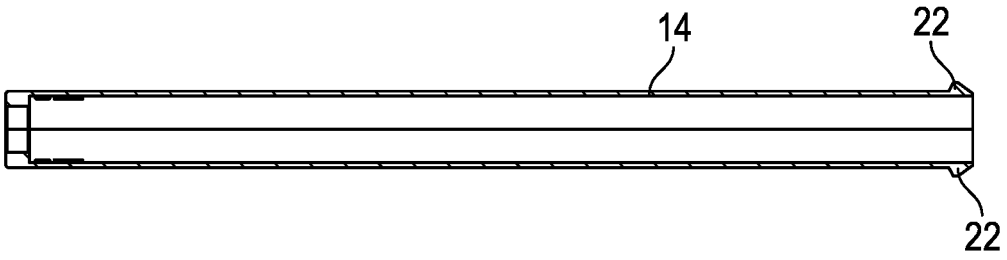
FIG. 4 is a side cross-sectional view of a tool shaft according to embodiments of the present disclosure.

FIG. **4*a* is an isometric view of the tool shaft of FIG. 4** according to embodiments of the present disclosure.

Figure 5:
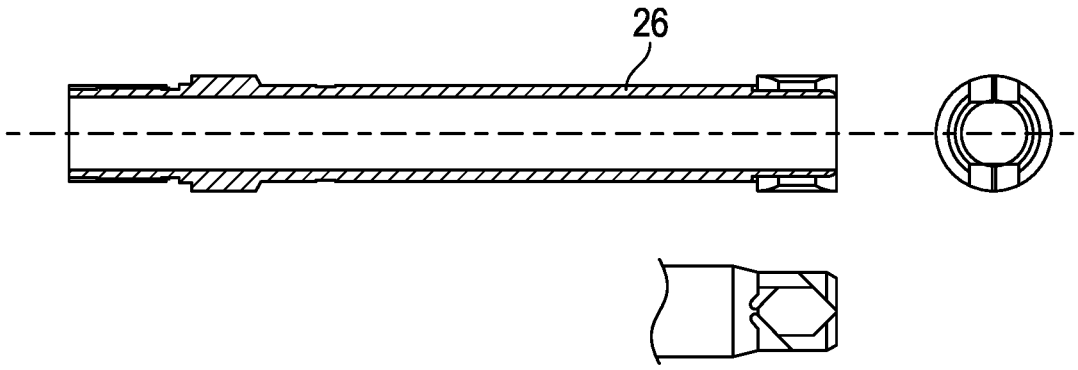

FIG. 5 is a side cross-sectional view of a modified motor nose for use with a protective sleeve according to embodiments of the present disclosure.

FIG. **5*a*** is an isometric view of the modified motor nose for use with a protective sleeve according to embodiments of the present disclosure.

Figure 6:
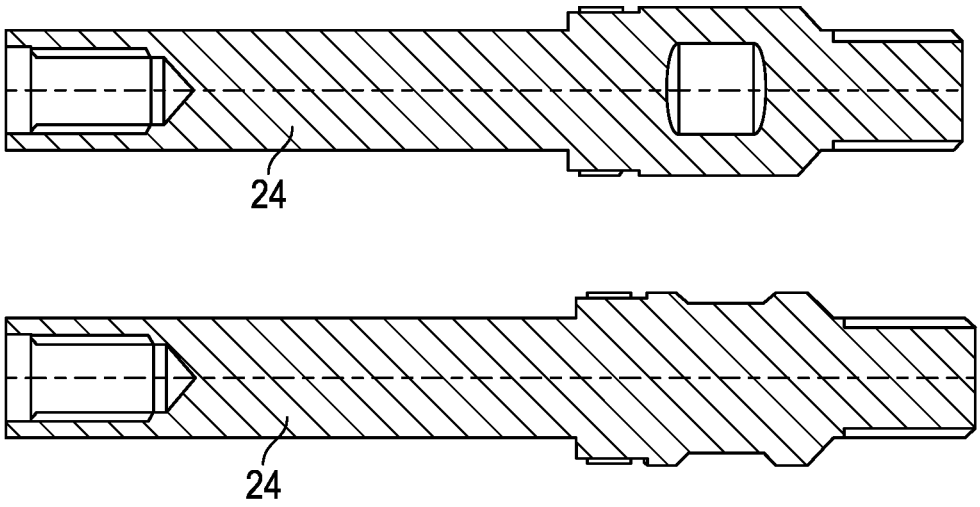

FIG. 6 is a side cross-sectional view of a motor shaft extension for use with a protective sleeve according to embodiments of the present disclosure.

FIG. **6*a*** is an isometric view of the motor shaft extension for use with a protective sleeve according to embodiments of the present disclosure.

Figure 7:
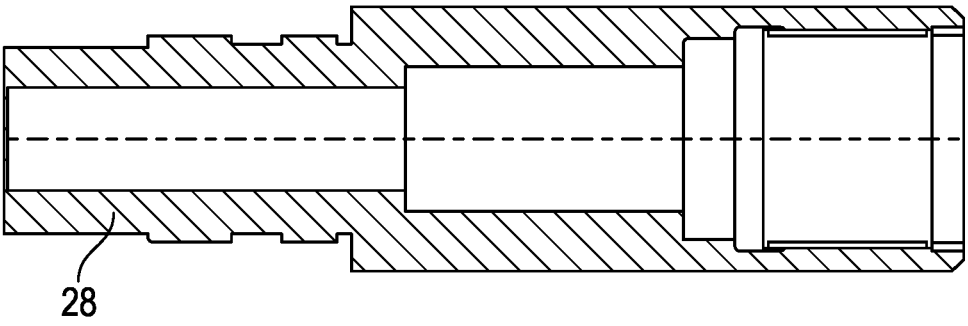

FIG. 7 is a side cross-sectional view of a motor nose adapter according to embodiments of the present disclosure.

Figure 7A:
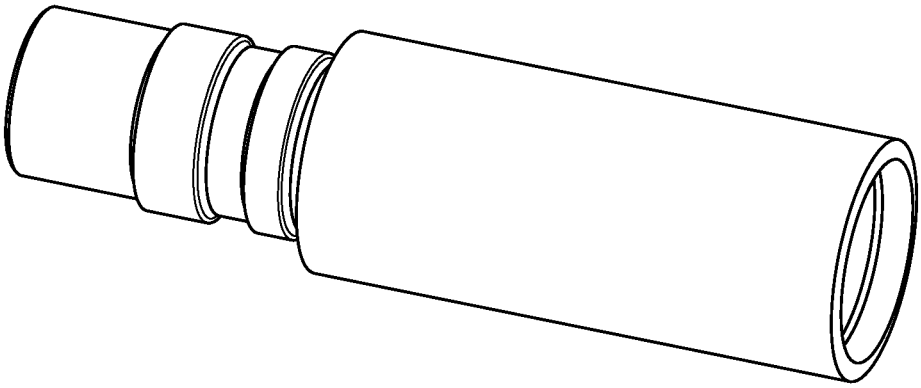

FIG. 7*a* is an isometric view of the motor nose adapter according to embodiments of the present disclosure.

Figure 8:
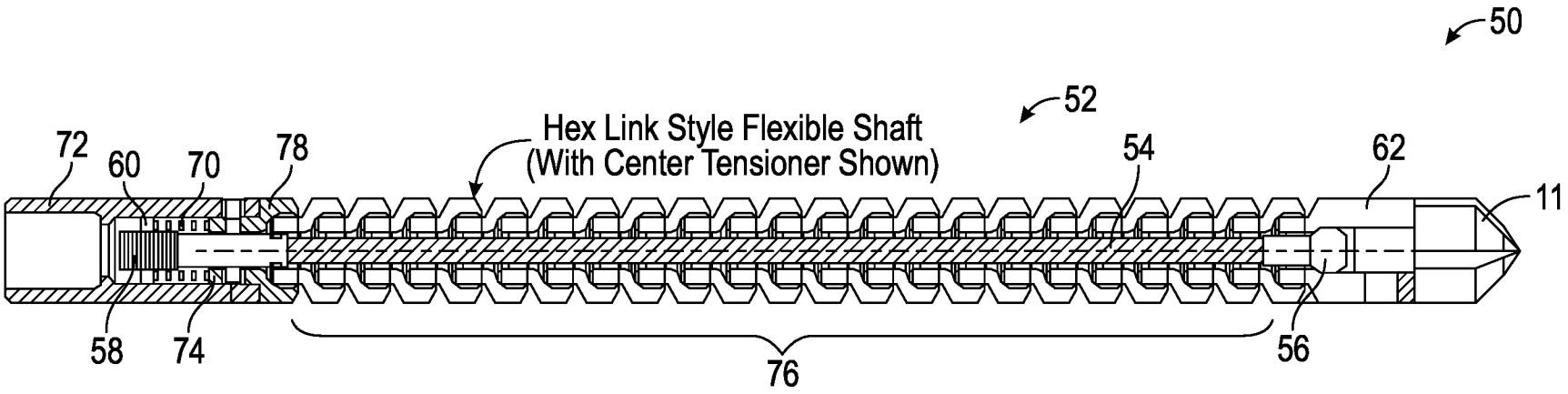

FIG. 8 is a cross-sectional view of a hex link tool shaft according to embodiments of the present disclosure.

Figure 9:
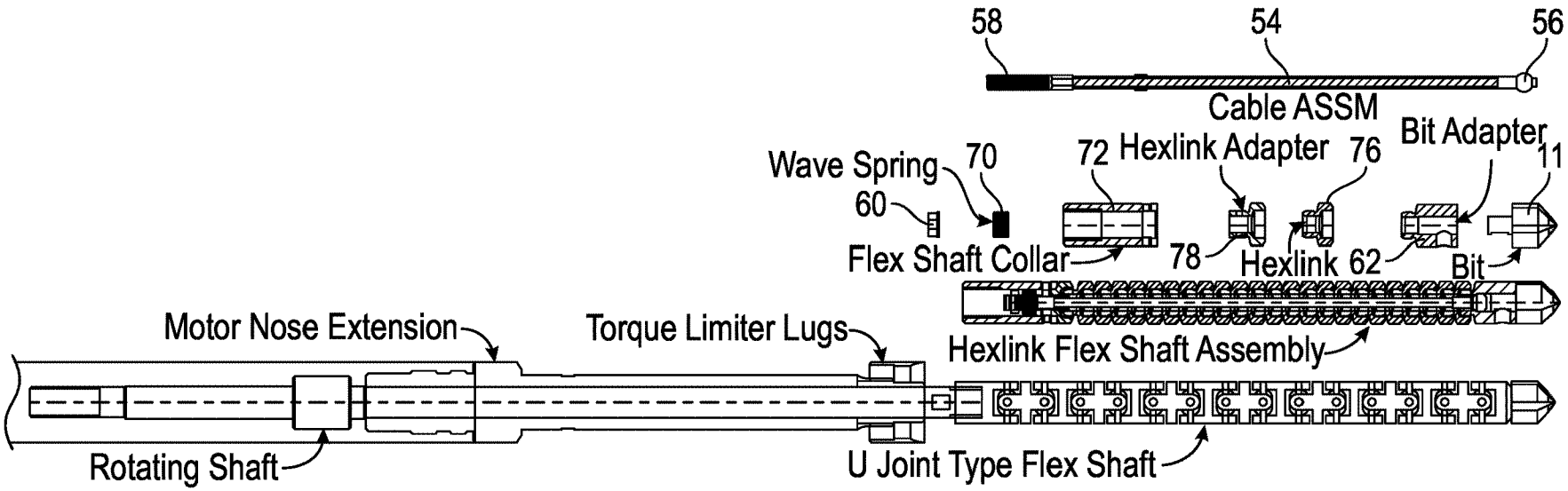

FIG. 9 is an exploded view of the components of FIG. 8 according to embodiments of the present disclosure.

Figure 10:
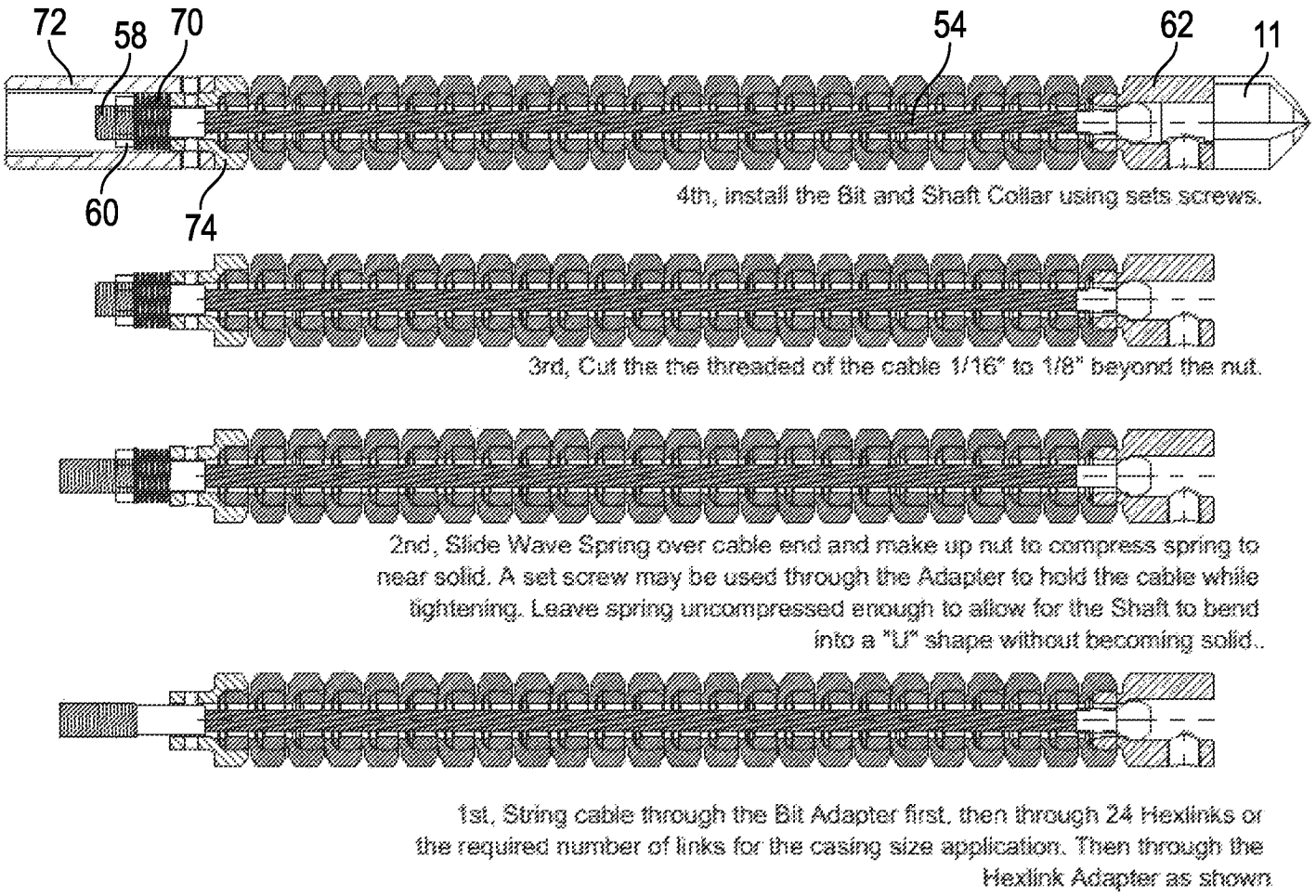

FIG. 10 is a four-part illustration of a method of constructing the hex link tool shaft according to embodiments of the present disclosure.

Figure 11:
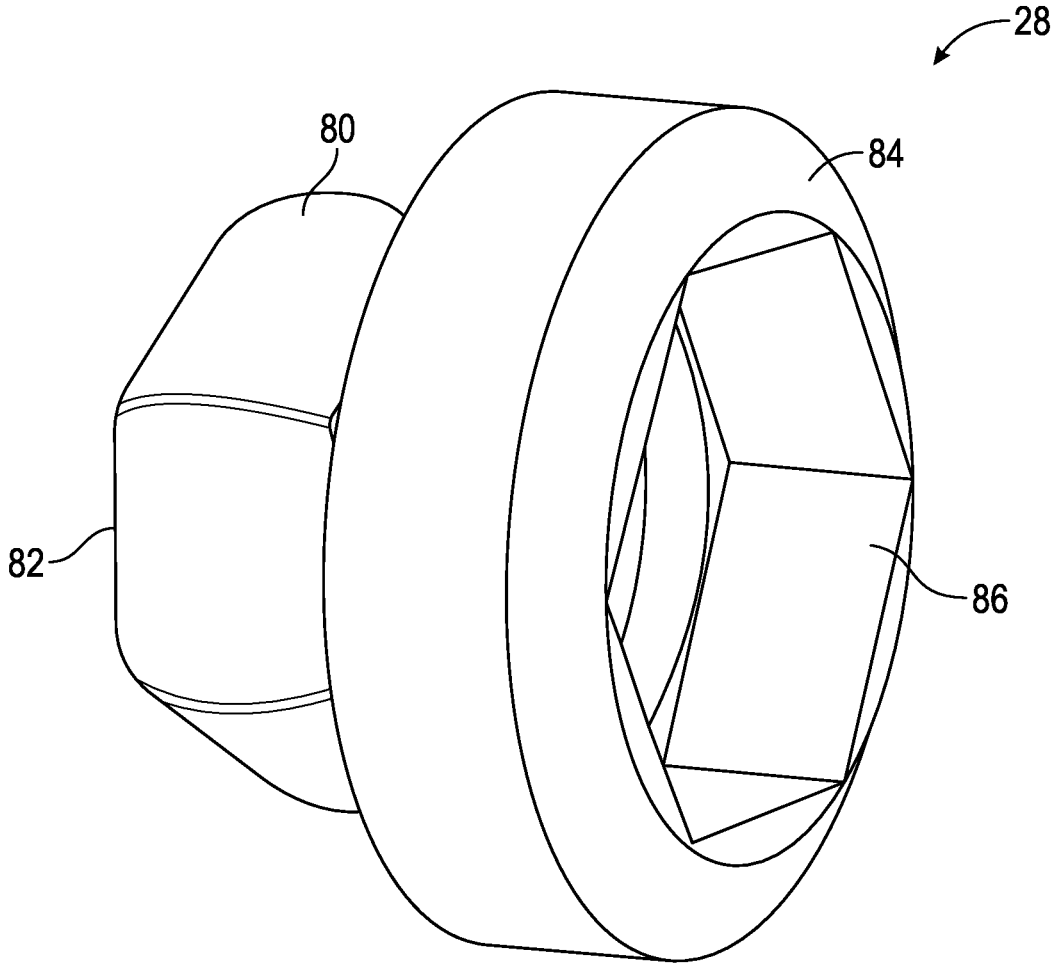

FIG. 11 is an isometric illustration of a single hex link according to embodiments of the present disclosure.

Figure 12:
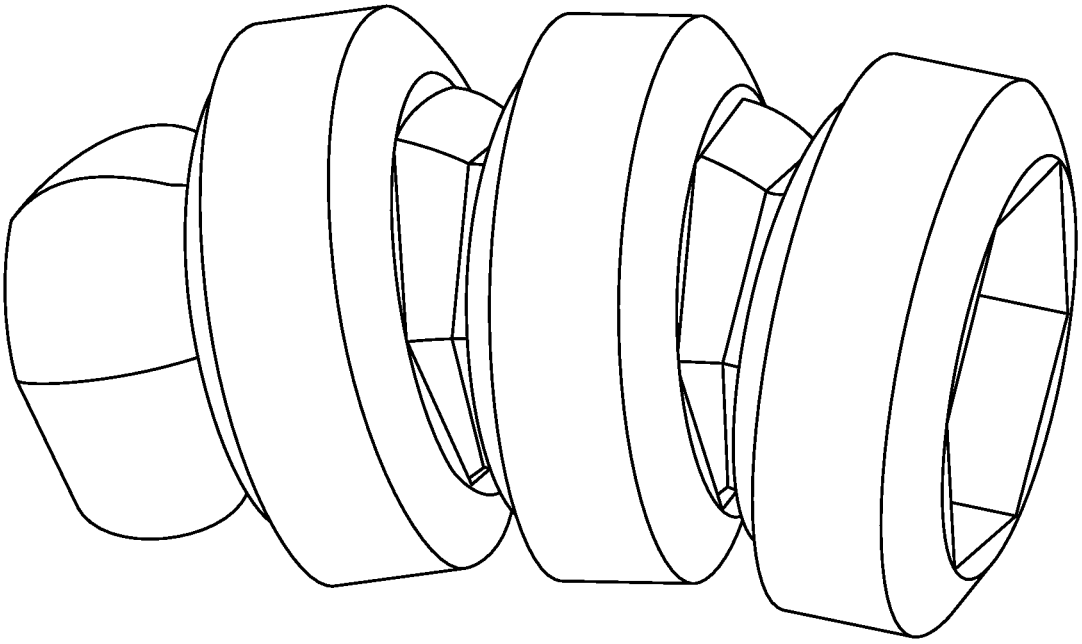

FIG. 12 is an isometric illustration of three hex links nested inside one another and in a flexed position according to embodiments of the present disclosure.

Figure 13:
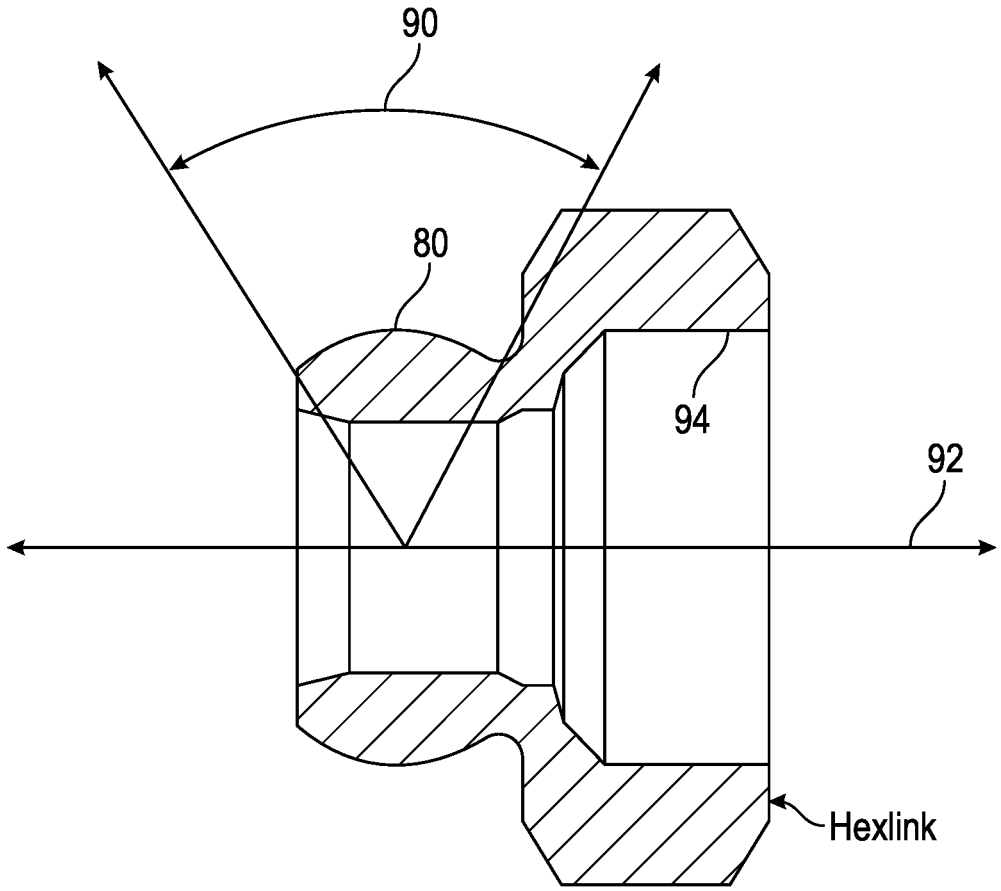

FIG. 13 is a cross-sectional view of a single link according to embodiments of the present disclosure.

DETAILED DESCRIPTION

Figure 1:
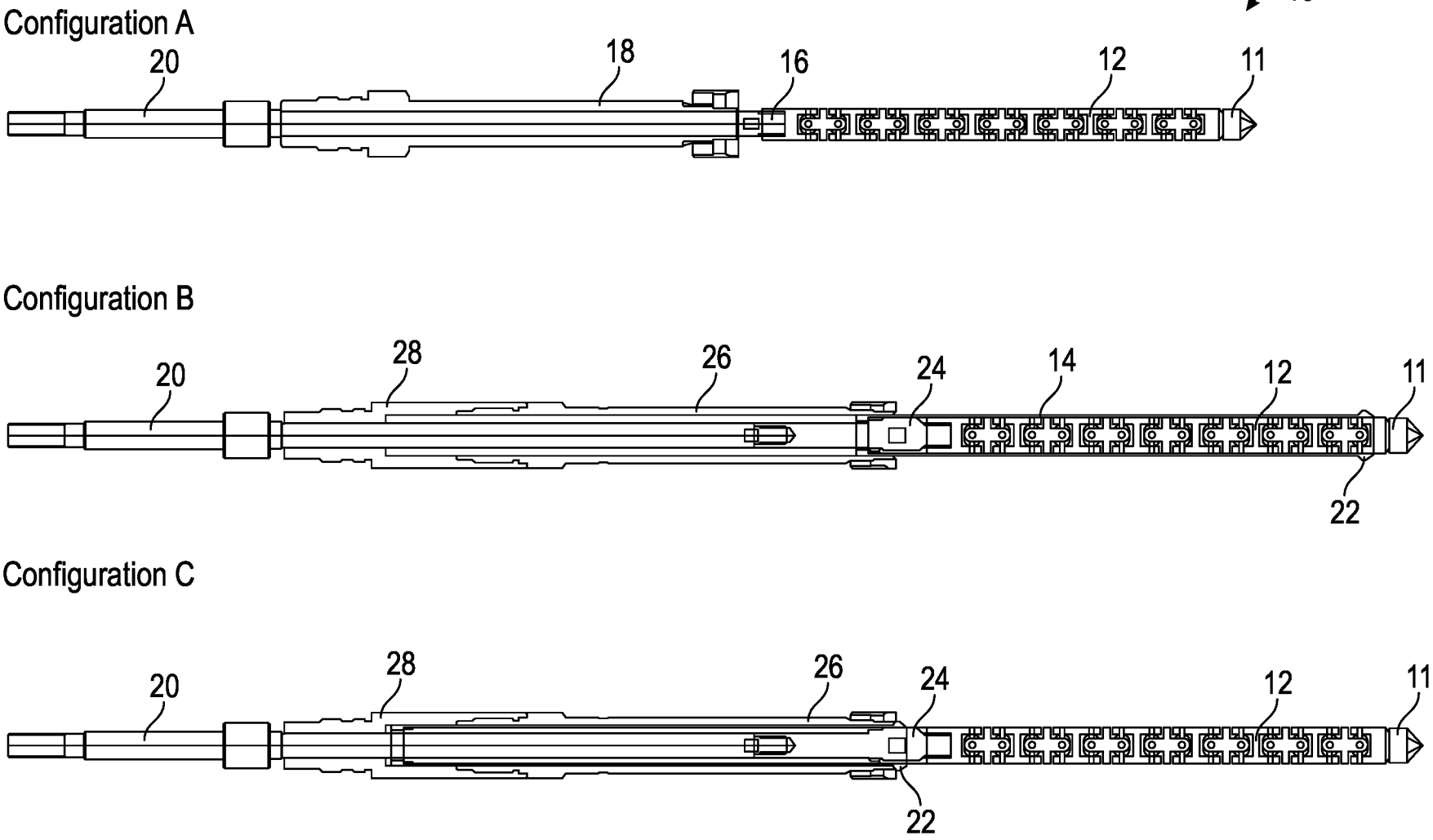
FIG. 1 is a side cross-sectional view of three configurations A, B, and C, of a tool shaft with supporting sleeve according to embodiments of the present disclosure.

FIG. 1 is a side cross-sectional view of three configurations A, B, and C, of an assembly 10 including a tool shaft 12 with a supporting sleeve 14 according to embodiments of the present disclosure. Referring to configuration A and beginning with a distal end and working toward a proximal end, the assembly 10 includes a bit 11, a tool shaft 12, a coupling 16, a motor nose 18, and a shaft 20. The protective sleeve is not shown in Configuration A. The tool shaft 12 can be rigid or flexible. The shaft 20 rotates to turn the tool shaft 12 and the bit to drill. The flexibility of the tool shaft 12 allows radial drilling to be performed. In some embodiments the tool shaft 12 is made up of a series of universal joints (a.k.a. U-joints) which allow torque to be transmitted along the shaft 12 even while the tool shaft 12 is bent away from straight. Other flexible components are possible as well. In some embodiments, the tool shaft 12 can be bent to greater than 90 degrees from the axis of the shaft 20.

Configuration B shows a protective sleeve 14 (a.k.a. sleeve 14), a motor shaft extension 24, and a modified motor nose 26. The sleeve 14 is shown extended over the tool shaft 12 and is rigid to prevent the tool shaft 12 from bending during run in hole ("RIH") or at any other time where bending is undesired. The sleeve 14 includes friction points 22 that are configured to engage a deflector shoe in a manner that will be shown and described below. The friction points 22 can be wider than the sleeve. In some embodiments the friction points 22 are made of a material designed to withstand contact with the well or objects in the well.

The modified motor nose 26 includes an annular space on an interior that is configured to receive the sleeve 14 within it. The sleeve 14 can be selectively retracted into the modified motor nose 26. Configuration B also includes a motor shaft extension 24 and a motor nose adapter to enable these components to fit together and operate as desired. Configuration C is the same as configuration B except the sleeve 14 has been retracted into the modified motor nose 26. Configurations A, B, and C can be variants of the same embodiment of the present disclosure at different stages of extension of the sleeve 14.

Figure 2:
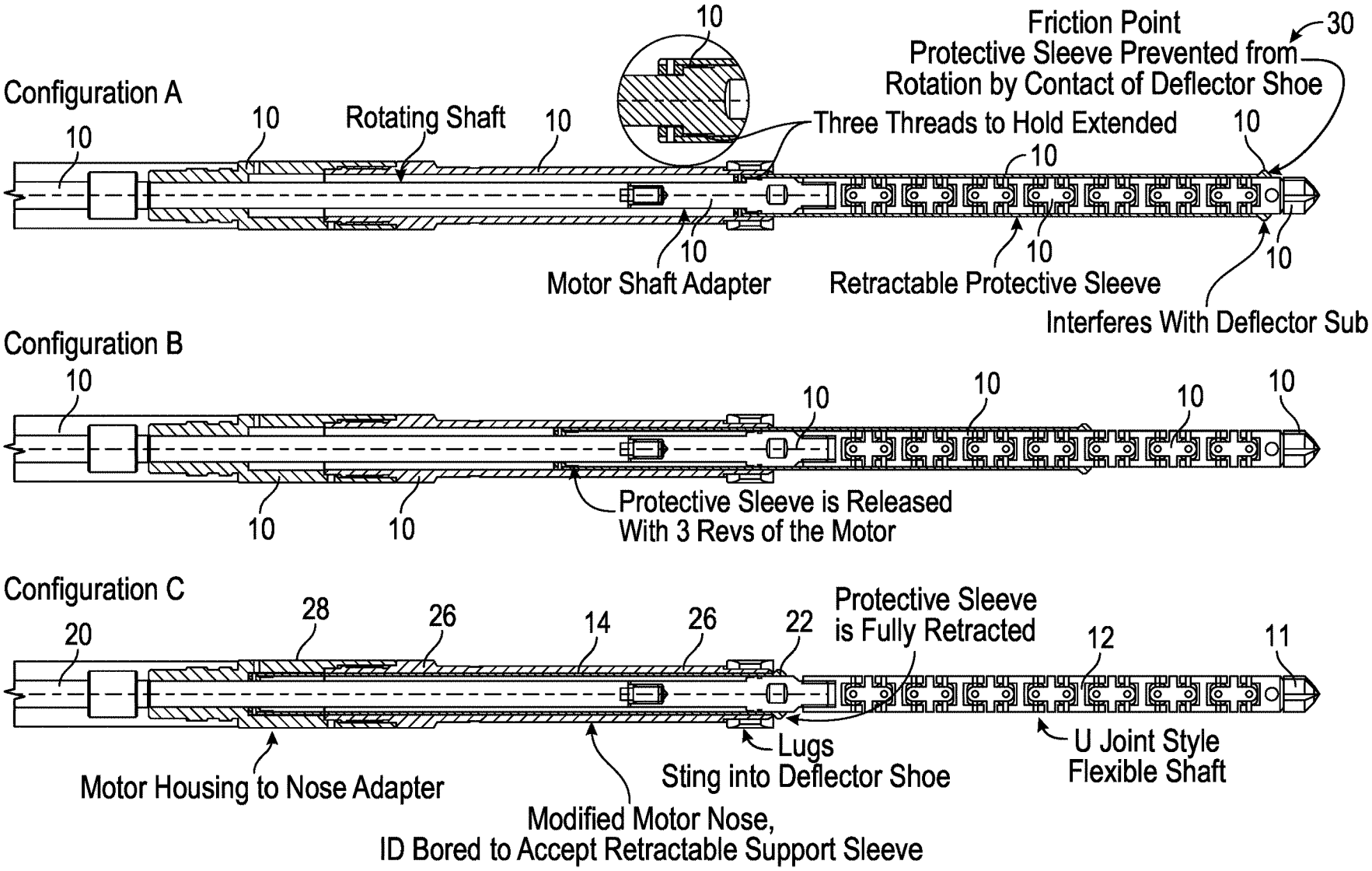
FIG. 2 is a side cross-sectional view of three configurations A, B, and C, of a tool shaft and protective sleeve including a threaded connection between the protective sleeve and the tool shaft according to embodiments of the present disclosure.

FIG. 2 is a side cross-sectional view of three configurations A, B, and C, of an assembly 30 including a tool shaft 12 and protective sleeve 14 including a threaded connection between the protective sleeve 14 and the tool shaft 12 according to embodiments of the present disclosure. Configuration A shows a threaded connection 32 between the sleeve 14 and the motor shaft extension 24. The threaded connection 32 can be formed between the sleeve 14 and a different rotating component of the shaft. In some embodiments the shaft extension 24 is not used and the sleeve 14 is threadably connected to another rotating component of the shaft. Configurations B and C show the same components as Configuration A except the sleeve 14 is partially retracted into the modified motor nose 26 in Configuration B, and fully retracted in Configuration C.

Figure 3:
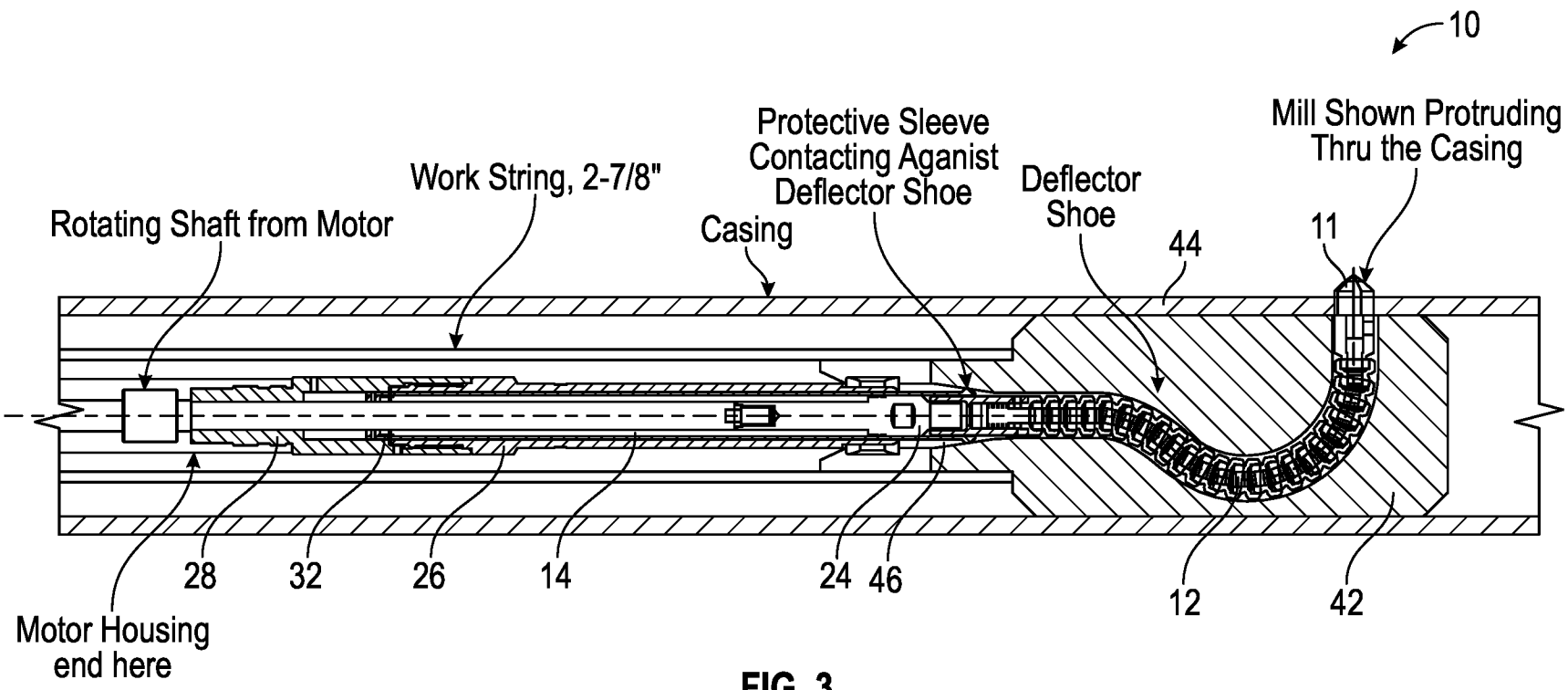
FIG. 3 is a side cross-sectional view of a tool shaft and protective sleeve and a deflector shoe according to embodiments of the present disclosure.

FIG. 3 is a side cross-sectional view of an assembly 40 including a tool shaft 12, a protective sleeve 14, and a deflector shoe 42 according to embodiments of the present disclosure. The assembly 40 includes components generally analogous to what is shown in FIGS. 1 and 2, including a bit 11, a shaft 12, a modified motor nose 26, motor shaft extension 24, motor nose adapter 28, and shaft 20. The assembly 40 is operable to ensure successful radial bore holes are created at the exit of the deflector shoe 42 into a casing 44. In some embodiments the protective sleeve 14 can be pre-assembled at surface to contain the tool shaft 12 inside the retractable protective sleeve 14. The sleeve 14 is prevented from axial movement and accidental exposure of the flexible driveshaft by a thread 32 that connects it to the modified motor nose 26, as shown to advantage in FIG. 2. Rotation in a direction that is opposite to motor rotation can be used to disengage the sleeve 14 from the thread 32 so the sleeve 14 can retract inside the modified motor nose 26 as soon as an axial load is applied.

The sleeve 14 includes friction points 22 which can be machined to match the profile of deflector shoe 42 entry and to have a large contact surface area. When the BHA lands on top of the deflector shoe 42, the friction points 22 contact a receptacle 46 on the deflector shoe 42. The contact force between the sleeve 14 and the deflector shoe receptacle 46 generates friction force. When the shaft 20 of the motor starts turning, the friction force between the friction points 22 of the sleeve 14 and the deflector shoe 42 prevents the sleeve 14 from rotating while the shaft 20 with threads that mate to the sleeve 14 spins inside the sleeve 14. The rotation of the shaft 20 under the sleeve 14 unthreads the sleeve 14 from the shaft 20 and allows it to retract into the modified motor nose 26. After the thread 32 disengages, the sleeve 14 is free to move and will slide inside the motor extension nose 26 if compressive force between the motor and deflector shoe 42 is applied. This action will expose the tool shaft 12. The sleeve 14 has an outer diameter and length smaller than the modified motor nose 26 so it will fit inside. A set-down force applied to the BHA will push the tool shaft 12 inside deflector shoe 42 as soon as the sleeve 14 is free to move.

Figure 4A:
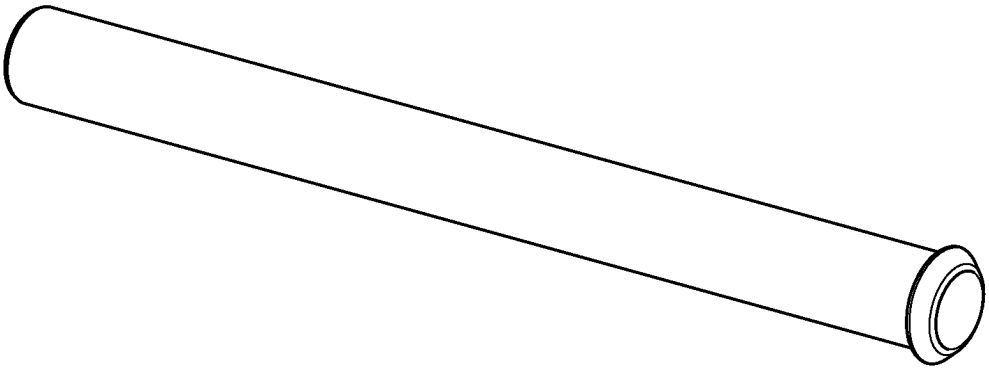

FIG. 4 is a side cross-sectional view of a protective sleeve 14 including friction points 22 according to embodiments of the present disclosure. FIG. 4*a* is an isometric view of the protective sleeve 14 of FIG. 4 according to embodiments of the present disclosure. In some embodiments the friction points 22 are triangular, lateral projections on a distal end of the protective sleeve 14. In other embodiments the friction points 22 can have a different profile. In some embodiments the friction points 22 can be shaped to complement a corresponding component on the deflector shoe or another component against which the sleeve 14 is urged to deliberately release the sleeve 14 and to allow it to retract into the shaft to permit the tool shaft to extend and to flex.

Figure 5A:
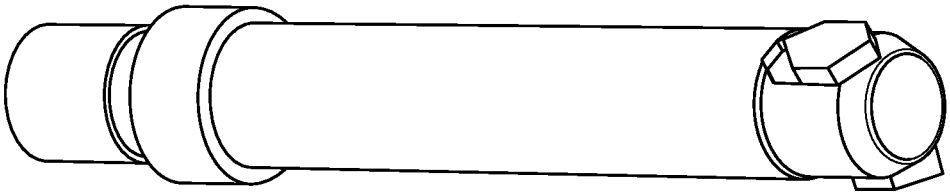

FIG. 5 is a side cross-sectional view of a modified motor nose 26 for use with a protective sleeve 14 according to embodiments of the present disclosure. FIG. 5*a* is an isometric view of the modified motor nose 26 of FIG. 5 for use with a protective sleeve 14 according to embodiments of the present disclosure. The motor nose 26 can have a different shape and configuration as needed to allow coupling with the tool shaft and protective sleeve. The motor nose 26 can have diamond-shaped projections at a distal end which permit coupling with the tool shaft and/or protective sleeve.

Figure 6A:
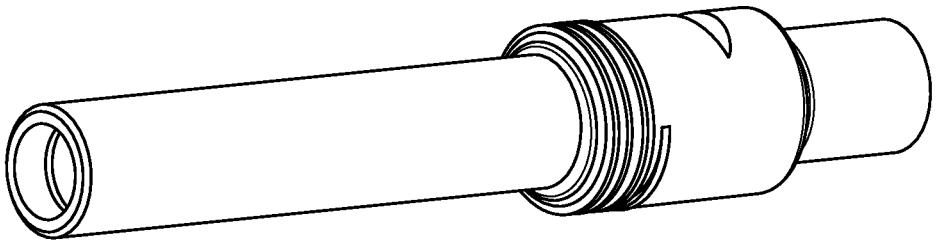

FIG. 6 is a side cross-sectional view of a motor shaft extension 24 for use with a protective sleeve 14 according to embodiments of the present disclosure. FIG. 6*a* is an isometric view of the motor shaft extension 24 for use with a protective sleeve 14 according to embodiments of the present disclosure. These components can work together to permit the protective sleeve 14 to protect the tool shaft 12 as it is run in hole and also operate to release the sleeve 14 from the tool shaft at the appropriate time and place.

FIG. 7 is a side cross-sectional view of a motor nose adapter 28 according to embodiments of the present disclosure. FIG. 7*a* is an isometric view of the motor nose adapter 28 according to embodiments of the present disclosure. These components can have varying dimensions and features and are described herein in terms of their functional aspects in addition to their physical characteristics. A person of ordinary skill in the art will appreciate there are multiple mechanical layouts that are possible to achieve the purposes of the defined system that fall within the scope of the present disclosure.

Embodiments of the present disclosure are directed to a drive shaft support sleeve including a motor nose adapter having a threaded connection with a positive displacement motor. A motor nose extension configured to contain the motor shaft adapter, and to provide connection and a release mechanism for the retractable support sleeve, and to contain the retractable sleeve after its retraction. A motor shaft adapter configured to provide a motor shaft extension between the motor shaft and the flexible drive shaft in order to accommodate for the additional length due to retractable support sleeve. A retractable support sleeve configured to encase and support flexible drive shaft and the drill bit during RIH, to interface with the deflector shoe, and to provide a mechanism for controlled retraction inside the motor extension once latched onto the deflector shoe receptacle. The sleeve retraction exposes the flexible driveshaft and enables its insertion inside the 90-degree deflector channel.

Embodiments of the present disclosure are directed to a hex-style linkage that allows bending or curvature away from the primary straight axis of the linkage but retains the ability to transmit torque through the linkage. In other embodiments the tool shaft transmits torque and includes a mechanical system that returns the tool shaft to a preferred orientation. Yet other embodiments of the present disclosure are directed to a mechanical system to return a series of hex links to a straight axial position or any other preferred position.

FIG. 8 is a cross-sectional view of a hex link tool shaft 50 according to embodiments of the present disclosure. FIG. 9 is an exploded view of the components of FIG. 8. Referring to both FIGS. 8 and 9, the hex link tool shaft 50 includes a cable assembly 52, a nut 60, a spring 70, and a flex shaft collar 72. The cable assembly includes a cable 54, a ball shank 56 at a distal end of the assembly, and a threaded portion 58 at a proximal end of the assembly. The terms proximal and distal are used herein to denote proximity to the surface and are not limiting in any way. The ball shank 56 fits within a bit adapter 62 which also holds the bit 11 at the distal end. The cable 54 extends through the center of the hex link tool shaft 50. The nut 60 is threadably connected to the threaded portion 58 within the flex shaft collar 72. The spring 70 is positioned between the nut 60 and a shoulder 74 of a hex adapter 78 which is coupled to the flex shaft collar 72. Turning the nut 60 allows for tension to be applied to the cable 54 which pulls on the ball shank 56 creating tension through the shaft. The tension in the cable system 52 applies a compressive force of substantially equal magnitude to the hex link assembly. When a bending load is applied to the entire assembly 50, the spring 70 will be compressed further and when the bending load is released the spring 70 will restore the hex link to the original axial orientation. The spring 70 can be a wave spring or a helical spring or another biasing member that creates a resistive force in the assembly as described herein. The hex link tool shaft 50 also includes hexagonal links 76 which are nested within one another. They have a hexagonal shape that allows them to carry a torque through the shaft, while still permitting the shaft to flex. In other embodiments the links have a different shape that is also capable of transmitting torque, such as an octagonal or other shape. These shapes are capable of transmitting torque and as such they are referred to as "torque-transmitting." It will be understood that there are other methods of transmitting torque that are not necessarily pictured here but the present disclosure includes these shapes and configurations.

FIG. 10 is a four-part illustration of a method of constructing the hex link tool shaft 50 according to embodiments of the present disclosure. As shown, starting with the bottom-most figure and working upwards, in some embodiments the first step is to string the cable 54 through the bit adapter 62, then through the hex links 76, however many there may be in a given installation. Then the cable 54 is threaded through the hex link adapter 72. Next, the spring 170, which can be a wave spring or a helical spring or any other suitable biasing member, is slid onto the portion of the cable 54 protruding from the hex link adapter 72, followed by a nut 60. A set screw (not shown) can be used in a hole 80 in the hex link adapter 72 to hold the cable 54 temporarily or permanently. The tension in the assembly determines how much flex is needed in the assembly. Too much tension and the assembly is more resilient but flexes less; too little tension and the hex links 76 may flex too much. A person of ordinary skill in the art will appreciate the tension can be varied easily by adjusting the nut 60. The cable 54 can be cut to length if needed, and last the bit 11 and flex shaft collar 72 can be installed on the distal and proximal ends, respectively. Each can be held in place with set screws (not shown).

FIG. 11 is an isometric illustration of a single hex link 76 according to embodiments of the present disclosure. The links 76 and cable system shown in previous figures are used to create pretension, achieved by passing the cable 54 through the links 76 (collectively, the linkage) that are anchored in a different way on both sides of the linkage. In the embodiment shown above, the cable 54 is anchored without any axial flexibility on the right hand side of the drawing where on the opposite side on the cable is wedged against the end of the linkage such that it cannot move axially into the linkage any further. On the left hand side of the drawing the cable 54 is tightened into a nut 60 that shoulders on a flexible element 70 (a spring in this case). The left hand anchor point of the cable 54 is free to move if force greater than the force applied by the nut 60 against the spring 70 is achieved. The force to compress the spring 70 is achieved by bending the flexible shaft 50. However, once the bending load is removed the shaft 50 will return to the original, straight position.

FIG. 12 is an isometric illustration of three hex links 76 nested inside one another and in a flexed position according to embodiments of the present disclosure. The portion of hex linkage shown in FIG. 12 retains the ability to transmit torque while flexing away from the straight axis of the linkage. The curved axis thru the linkage is longer than the straight axis of the linkage, and the increased distance will cause a pretensioned cable that passes through the linkage to either grow in length or compress the flexible element at the termination point of the cable.

FIG. 13 is a cross-sectional view of a single link 76 according to embodiments of the present disclosure. The links 76 can have a small end 82 and a large end 84, where the small end of one link is nested into the large end of the next link, and so on and so forth to create the linkage. The links 76 can have a radius on the outer surface 80 of the small end 82, also called the external hex. The radius allows a series of hex links 76 to bend away from the primary axis of the linkage while still transmitting torque in the circumferential direction. The radius is shown by the arrows and the arc 90 in FIG. 13. In other embodiments, an interior surface 94 of the large end 84 can have a similar radius. In still other embodiments, both the small end 82 and the large end 84 can have the radius, in which case the radius can be less for each piece. When such a linkage is bent, the distance along the axis of the linkage increases compared to the straight distance of an unbent linkage. The interior surface 86 in this embodiment is hexagonal; however, other embodiments can have a square, pentagonal, or any other suitable shape that permits the links to carry torque through the linkage.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

The invention claimed is:

1. A system for deploying a shaft, comprising:

a support shaft configured to be operatively coupled to a motor to rotate the support shaft;

a motor nose coupled to the support shaft, the motor nose having a first coupling and a second coupling, wherein the first coupling is radially inward of the second coupling;

a tool shaft coupled to the first coupling and being configured to rotate with the support shaft and the motor nose, the tool shaft having an outer diameter; and a protective sleeve coupled to the second coupling on the motor nose, wherein the protective sleeve is rigid and has an interior diameter slightly larger than the outer diameter of the tool shaft, wherein the tool shaft is configured to rest within the protective sleeve such that the protective sleeve prevents the tool shaft from flexing, and wherein the protective sleeve is configured to selectively retract into the motor nose to reveal the tool shaft, wherein the protective sleeve is threadably coupled to the motor nose, and wherein the protective sleeve is threadably releasable from the motor nose by operating the motor in a predetermined pattern, and wherein after releasing from the motor nose the protective sleeve is permitted to slide axially into the motor nose.

2. The system of claim 1 wherein the support shaft defines an axial direction, and wherein the first coupling is movable relative to the second coupling along the axial direction.

3. The system of claim 1, further comprising a drill bit coupled to the tool shaft and being configured to rotate under power of the motor.

4. The system of claim 1 wherein the tool shaft comprises a plurality of universal joints.

5. The system of claim 1, further comprising a deflector shoe configured to divert the tool shaft away from an axis of the shaft to perform a deviated drilling operation, wherein the deflector shoe is positioned in the well.

6. The system of claim 5 wherein the protective sleeve has friction points configured to contact the deflector shoe to release the protective sleeve to permit the protective sleeve to slide into the motor nose.

7. The system of claim 1 wherein the tool shaft comprises:

a flex shaft collar having a torque-transmitting radial surface;

a cable coupled to the flex shaft collar, the cable having a proximal end coupled to the first coupling and a distal end;

a ball shank at the distal end of the cable;

a plurality of links nested into one another, each link having an interior bore configured to receive the cable, wherein the links have a torque-transmitting radial surface, and wherein the torque-transmitting radial surface of the flex shaft collar and of the links are configured to couple together such that imparting a torque to the links imparts the torque to the next successive link; and a bit adapter coupled to the distal end of the cable and configured to contact one of the links such that tension in the cable causes the bit adapter and the flex shaft collar to move toward one another.

8. The system of claim 7 wherein when the bit adapter is in a contracted position the links are brought into contact with one another such that the torque-transmitting radial surfaces are in sufficient contact to transmit torque.

9. The system of claim 7 wherein when the bit adapter is in a contracted position the links are brought into contact with one another such that the links prevent the cable from flexing.

10. The system of claim 7 wherein when the bit adapter is in a relaxed position the torque-transmitting radial surfaces are not in contact and the cable is permitted to flex.

11. The system of claim 1 wherein the tool shaft is flexible, wherein the protective sleeve prevents the tool shaft from bending and when retracted permits the tool shaft to bend.

12. The system of claim 1 wherein the tool shaft comprises at least one of a tension hose, a hollow cable, or a torque-transmitting cable.

13. A method of deploying a shaft into a wellbore, comprising:

coupling a shaft to a motor shaft such that the motor shaft can rotate the shaft to perform a drilling operation;

coupling a protective sleeve to the motor shaft with the protective sleeve covering substantially all the shaft;

running the shaft and protective sleeve into a wellbore;

retracting the protective sleeve from the shaft such that the shaft is permitted to flex;

contacting a deflector shoe, wherein the deflector shoe is configured to direct the shaft to deviate from an axis of the motor shaft, wherein contacting the deflector shoe further comprises rotating the motor shaft in a predetermined pattern to threadably release the protective sleeve from the motor shaft to permit the protective sleeve to retract into the motor shaft;

rotating the motor shaft and the shaft to perform the drilling operation.

14. The method of claim 13 wherein retracting the protective sleeve from the shaft comprises contacting the deflector shoe and causing an axial force on the protective sleeve to retract the protective sleeve.

15. A tool shaft, comprising:

a flex shaft collar having a torque-transmitting radial surface;

a cable coupled to the flex shaft collar, the cable having a proximal end and a distal end, wherein the proximal end is coupled to the flex shaft collar;

a plurality of links nested into one another, each link having an interior bore configured to receive the cable, wherein the cable passes through the interior bore of the links, and wherein the links have a torque-transmitting radial surface, and wherein the torque-transmitting radial surface of the flex shaft collar and of the links are operably coupled together such that imparting a torque to the flex shaft collar imparts the torque through the links;

a bit adapter coupled to the distal end of the cable and configured to abut one of the links such that tension in the cable causes the bit adapter and the flex shaft collar to move toward one another;

a deflector shoe configured to be coupled to the tool shaft, the deflector shoe having an interior passage deviated from an axis of the tool shaft and configured to direct the tool shaft in a direction lateral to the axis of the tool shaft;

a shaft coupled to the flex shaft collar; and a protective sleeve configured to move along the shaft between a retracted position and an extended position by operating a motor in a predetermined pattern to release a threaded coupling, the sleeve being at least slightly larger than the links in a radial direction such that the cable and links fit within the sleeve in the retracted position, wherein the sleeve is sufficiently rigid to substantially prevent the cable from flexing when in the extended position.

16. The tool shaft of claim 15, further comprising a ball shank at a distal end of the cable, the ball shank being larger than the interior bore of at least a distal link such that the ball shank cannot pass through the interior bore, the ball shank being configured to urge the links together when the flex shaft is in tension.

17. The tool shaft of claim 15 wherein the cable comprises a plurality of universal joints.

18. The tool shaft of claim 15 wherein the shaft is a flexible shaft.

19. The flexible shaft of claim 15 wherein the torque-transmitting radial surfaces are configured to transmit torque even when the links are deviated from one another.

* * * * *